US006351062B1

(12) United States Patent
Nishizawa et al.

(10) Patent No.: US 6,351,062 B1
(45) **Date of Patent: *Feb. 26, 2002**

(54) CATHODE RAY TUBE HAVING HIGH AND LOW REFRACTIVE INDEX FILMS ON THE OUTER FACE OF THE GLASS PANEL THEREOF

(75) Inventors: Masahiro Nishizawa; Norikazu Uchiyama, both of Mobara; Toshio Tojo, Ichinomiya-machi, all of (JP)

(73) Assignees: Hitachi, Ltd., Tokyo; Hitachi Device Engineering Co., Ltd., Chiba-ken, both of (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/667,707

(22) Filed: Sep. 22, 2000

Related U.S. Application Data

(63) Continuation of application No. 09/395,354, filed on Sep. 14, 1999, now Pat. No. 6,163,109, which is a continuation of application No. 08/916,668, filed on Aug. 22, 1997, now Pat. No. 5,973,450.

(30) Foreign Application Priority Data

Aug. 29, 1996 (JP) ..... 8-228382

(51) Int. Cl.[7] ..... H01J 29/88
(52) U.S. Cl. ..... 313/478; 313/479
(58) Field of Search ..... 313/478, 479, 313/112, 403

(56) References Cited

U.S. PATENT DOCUMENTS

| | | | | |
|---|---|---|---|---|
| 4,859,901 A | | 8/1989 | Thompson-Russell | 313/403 |
| 5,153,481 A | | 10/1992 | Matsuda et al. | 313/479 |
| 5,412,278 A | | 5/1995 | Iwasaki | 313/478 |
| 5,519,282 A | | 5/1996 | Takizawa et al. | 313/478 |
| 5,523,649 A | | 6/1996 | Tong et al. | 313/479 |
| 5,550,429 A | | 8/1996 | Hayama et al. | 313/479 |
| 5,580,662 A | | 12/1996 | Tong et al. | 428/432 |
| 5,652,476 A | | 7/1997 | Matsuda et al. | 313/478 |
| 5,660,876 A | | 8/1997 | Kojima et al. | 427/64 |
| 5,698,940 A | | 12/1997 | Ballato et al. | 313/479 |
| 5,789,854 A | | 8/1998 | Takizawa et al. | 313/478 |
| 5,973,450 A | * | 10/1999 | Nishizawa et al. | 31/478 |
| 6,163,109 A | * | 12/2000 | Nishizawa et al. | 313/498 |

FOREIGN PATENT DOCUMENTS

| | | | | |
|---|---|---|---|---|
| EP | 0276459 | | 8/1988 | H01J/29/89 |
| EP | 0356229 | | 2/1990 | H01J/29/28 |
| EP | 0533255 | | 3/1993 | H01J/29/86 |
| EP | 0565026 | | 10/1993 | H01J/29/89 |
| EP | 0589147 | | 3/1994 | H01J/29/89 |
| EP | 0649160 | | 4/1995 | H01J/29/86 |
| GB | 2161320 | | 1/1986 | H01J/29/88 |
| JP | 2-027549 | | 12/1990 | H01J/29/88 |
| JP | 4-334853 | | 11/1992 | H01J/29/88 |
| WO | WO 98/49707 | * | 11/1998 | H01J/9/20 |

OTHER PUBLICATIONS

Patent Abstracts of Japan, Pub. No. 09022668 (Jan. 21, 1997), "Cathode Ray Tube" by H. Hidekazu, et al.

"Anti–glare, Anti–reflection and Anti–static (AGRAS) Coating for CRT's", H. Tohda, et al., 12$^{th}$ International Display Research Conf., Japan, Display 92, Oct. 12–14, 1992, pp. 289–292.

* cited by examiner

*Primary Examiner*—Michael H. Day
(74) *Attorney, Agent, or Firm*—Antonelli, Terry, Stout & Kraus, LLP

(57) ABSTRACT

A cathode ray tube with a vacuum enclosure, including a glass panel having an inner face coated with a phosphor film to form a screen, a neck portion housing an electron gun, and a funnel portion connecting the glass panel and the neck portion. A high refractive index film made of electrically conductive metal oxide or metal (e.g., precious metal) particles and having a refractive index of 1.6 to 2.2, and a low refractive index film having a refractive index of 1.3 to 1.58, are formed on the outer face of the glass panel. The high refractive index film is sandwiched between the outer face of the glass panel and the low refractive index film and an average roughness of an outer surface of said low refractive index film is less than an average roughness of an unevenness of an interface between the high refractive index film and the low refractive index film.

20 Claims, 9 Drawing Sheets

CATHODE RAY TUBE HAVING HIGH AND LOW REFRACTIVE INDEX FILMS ON THE OUTER FACE OF THE GLASS PANEL THEREOF

This application is a Continuation of application Ser. No. 09/395,354, filed Sep. 14, 1999, now U.S. Pat. No. 6,163, 109, issued Dec. 19, 2000, which is a continuation of application Ser. No. 08/916,668, filed Aug. 22, 1997, the contents of which are incorporated herein by reference in their entirety, now U.S. Pat. No. 5,973,450, issued Oct. 26, 1999.

BACKGROUND OF THE INVENTION

The present invention relates to a cathode ray tube and, more particularly, to a cathode ray tube which prevents the reflection of external light on a glass panel portion of the tube envelope, so as to raise the display contrast and prevent the formation of an electrostatic charge on the screen.

In a cathode ray tube to be used in a TV receiver or a personal computer monitor, a tube envelope in the form of a glass vacuum enclosure is used, which comprises a glass panel having a screen or an image display screen formed thereon, a neck portion housing electron guns and a funnel portion connecting the glass panel and the neck portion. A phosphor film representing the screen formed on the inner face of the glass panel is excited with modulated electron beams emitted from the electron guns to display a desired image.

FIG. 11 is a section view for explaining the structure of a shadow mask color cathode ray tube, which represents one example of a cathode ray tube with which the present invention is concerned. In FIG. 11, reference numeral 1 designates a glass panel portion; numeral 2 denotes a neck portion; numeral 3 denotes a funnel portion; numeral 4 denotes a phosphor screen; numeral 5 denotes a shadow mask; numeral 6 denotes a mask frame; numeral 7 denotes mask support mechanism; numeral 8 denotes support pins; numeral 9 denotes an inner magnetic shield; numeral 10 denotes anode button; numeral 11 denotes an internal conductive coating; numeral 12 denotes a deflector: numeral 13 denotes electron guns; and numeral 14 denotes electron beams (red, green and blue). In the cathode ray tube shown in FIG. 1 a tube envelope in the form of a vacuum enclosure is constructed of the glass panel portion 1 on which the screen (phosphor film 4) is formed, the neck portion 2 housing the electron guns and the funnel portion 3 connecting the glass panel portion and the neck portion. The inner wall surface of this vacuum enclosure is coated with the internal conductive coating 11 for supplying a high anode voltage, applied to the anode button 10, to the screen and the electron guns.

The shadow mask 5 is welded to the mask frame 6 and is suspended by the support mechanism 7 from the support pins 8, which are buried in the inner wall of the skirt portion of the glass panel portion 1, so that the shadow mask is held at a predetermined small spacing from the phosphor screen 4 formed on the inner face of the glass panel portion 1.

The inner magnetic shield 9 is provided for shielding the image display from the bad influences of external magnetic fields, such as the earth's magnetism, upon the electron beams 14 and is welded to and held by the mask frame 6.

On the neck portion side of the funnel portion 3, there is mounted the deflection coils 12 for establishing a horizontal magnetic field and a vertical magnetic field within the tube envelope, so that the three modulated electron beams emitted from the electron guns 13 are deflected in the horizontal direction and in the vertical direction to scan the phosphor film two-dimensionally and thereby to display a desired image.

Generally, this cathode ray tube is provided with an anti-reflection, anti-electrostatic charge film on the outer surface of the glass panel 1 for preventing the reflection of external light incident upon the glass panel portion or the image display screen from being reflected thereby, to prevent deterioration of the contrast of the image display or for preventing the glass panel portion from being charged with static electricity.

FIG. 12 is a section view showing, on an enlarged scale, a portion A of the glass panel portion of FIG. 11 for explaining one example of an external light anti-reflection structure of the cathode ray tube. In FIG. 12, reference numeral 42 designates a black matrix; numeral 43 denotes a phosphor screen; numeral 44 denotes a metal back; numeral 51 denotes an electron beam passing opening of the shadow mask; symbols R, G and B denote the trajectories of electron beams of individual colors; numeral 20 denotes an anti-reflection, anti-electrostatic charge film; numeral 23 denotes light emitted from the phosphor screen; numeral 24 denotes external light incident on the glass panel of the cathode ray tube; and numerals 25 and 26 denote reflected external light. The same reference numerals as those of FIG. 11 designate identical elements.

In FIG. 12, the three electron beams (R, G and B), emitted from the electron guns, are subjected to color selection for the individual phosphor dots 43 of the R, G and B colors by the electron beam passing opening 51 of the shadow mask 5 to cause them to impinge upon the proper color dots of the phosphor screen 4.

The phosphor dots 43 are excited by the impingement of the electron beams to emit light, which passes through the glass panel portion 1. The anti-reflection, anti-electrostatic charge film 20 is formed on the outer surface of the glass panel portion. The external light 25 which reaches the anti-reflection, anti-electrostatic charge film 20 of the glass panel portion 1 is suppressed in light energy through absorption or interference in the anti-reflection, anti-electrostatic charge film 20, so that normal reflection of this light toward the outer surface of the film 20 is prevented together with diffusion of reflected light 26 by the surface of the anti-reflection, anti-electrostatic charge film 20.

This anti-reflection, anti-electrostatic charge film is formed by one of various methods, but generally it is formed by the so-called "sol-gel-method."

Specifically, there is disclosed in Japanese Patent Laid-Open No. 334853/1992 a method of forming a two-layered anti-reflection, anti-electrostatic charge film by forming a film of a mixed composition in which ultra fine particles (having a diameter no more than several tens of nm) of a conductive oxide (e.g., A.T.O.: tin oxide containing antimony oxide, or I.T.O.: indium oxide containing tin oxide) for forming a high refractive index film are dispersed in an alcoholic solution, by so-called "spin-coating" to form a flat lower film having a thickness of about 60 to 100 nm, and by spin- or spray-coating the underlying film with a hydrolysate solution of silicon alkoxide to form a flat upper film having a thickness of 80 to 130 nm.

There is also disclosed in Japanese Patent Laid-Open No. 343008/1993 a method in which a film of an organic or inorganic tin compound containing antimony is formed on the glass panel of a cathode ray tube by chemical vapor deposition (hereinafter abbreviated to CVD) to form an A.T.O. film having a high refractive index, the A.T.O. film is coated flatly with a hydrolysate solution of silicon alkoxide of a thickness of 80 to 100 nm to form a film having a low refractive index, the second-layer film is spray-coated with the hydrolysate solution of silicon alkoxide to a thickness of 10 to 50 nm to form a third-layer scattering film having a low refractive index, so as to reduce the density of the reflected color exhibited by the second-layer of the anti-reflection, anti-electrostatic charge film and the reflectance in the human visible region of 400 to 700 nm, and the third-layer film is made uneven.

SUMMARY OF THE INVENTION

In the processes described above, the structure, in which a low refractive index film is formed over a high refractive index are individually made flat, is made substantially identical to the theoretical one for the two-layered anti-reflection film (described on pp. 100 to 103, OPTICAL THIN FILM written by Kozo Ishiguro et al., 1986, KYORITSU SHUPPAN). As a result, the structure has a V-shaped reflection characteristic, in the form of a reflection spectrum in which the reflectances at the two wavelengths at the ends of the visible region or 400 to 700 nm are higher than that at the central wavelength.

When the reflectance in the visible region is lowered, therefore, the reflectances at the two wavelengths at the ends are higher than that at the central wavelength. As a result, the color of the reflected light, i.e., the reflection color is intensified, and the reflectance is raised when the reflection color is reduced. In order to diminish this undesirable effect, a third-layer film in the form of an uneven film having a small thickness and a low refractive index is used. However, this effect is not sufficient when the height of the unevenness is small and the density thereof is high, namely, when the number of projections and recesses per unit area is large. On the other hand, when the height of the unevenness is large and the density thereof is high, the intensity of the scattering is increased to lower the resolution of the cathode ray tube.

Since a high refractive index film is formed by spin-coating or CVD processes, there arises a problem in that the process is complicated, resulting in an increase in the cost of manufacture.

An object of the present invention is to solve the aforementioned problems of the prior art and to provide a cathode ray tube having an anti-reflection, anti-electrostatic charge film which prevents the reflection of external light on a glass panel portion thereof, resulting in an increase in the contrast, while preventing formation of an electrostatic charge.

In a cathode ray tube of the present invention, a multi-layered anti-reflection, anti-electrostatic charge film formed on the outer face of the glass panel includes a high refractive index film having a refractive index of 1.6 to 2.2 and a low refractive index film having a refractive index of 1.3 to 1.58. The high refractive index film is sandwiched between the outer face of the glass panel and the low refractive index film, and an unevenness having an average diameter of 5 to 80 $\mu$m is formed at the interface between the high refractive index film and the low refractive index film. The interface has a height of 10 to 40 nm. The unevenness of the outer surface of the low refractive index film is smaller than the average roughness Rz of the unevenness of the interface between the high refractive index film and the low refractive index film, or the outer surface of the low refractive index film is flat.

In the cathode ray tube of the present invention, moreover, the high refractive index film and the low refractive index film are made of anti-reflection, anti-electrostatic charge films which are formed by a spray-coating step, followed by a spin-coating step or a spray-coating step, and then a spray-coating step in this order.

According to a first aspect of the present invention, there is provided a cathode ray tube comprising a vacuum enclosure including a glass panel whose inner face is coated with a phosphor film to form a screen, a neck portion housing electron guns, and a funnel portion connecting the glass panel and the neck portion, wherein a high refractive index film (of a refractive index of 1.6 to 2.2) and a low refractive index film (of a refractive index of 1.3 to 1.58) are formed on the outer face of the glass panel, with the high refractive index film being sandwiched between the outer face of the panel glass and the low refractive index film, and an unevenness having an average diameter of 5 to 80 $\mu$m and a height of 10 to 40 nm is provided at the interface between the high refractive index film and the low refractive index film.

According to a second aspect of the present invention, moreover, the outer surface of the low refractive index film is flattened (the average roughness Rz being no more than 10 nm).

With this type of construction, the characteristic curve of reflection is flattened to lower the average reflectance in the range of 400 to 700 nm and the dependence of the intensity of the reflected light on the wavelength is weakened to improve the image clarity of the cathode ray tube.

According a third aspect of the present invention, the low refractive index film has an average roughness Rz of more than 10 nm on its outer surface. Thanks to this construction, the image clarity of the cathode ray tube is improved even further by the diffuse reflection of external light from the low refractive index film.

According to a fourth aspect of the present invention, moreover, the average roughness Rz of the outer surface of the low refractive index film is smaller than the average roughness Rz of the unevenness of the interface between the high refractive index film and the low refractive index film. Thanks to this construction, the image clarity of the cathode ray tube is also improved by the diffuse reflection of external light from the low refractive index film. Here, the image clarity of the cathode ray tube is improved even more if the average roughness Rz of the unevenness of the outer surface of the low refractive index film and the number of projections and recesses per unit area are smaller than those of the interface between the low refractive index film and the high refractive index film.

According to a fifth aspect of the present invention, moreover, the material for forming the high refractive index film contains particles of a conductive oxide or metal, and the material for forming the low refractive index film contains a silicon compound or a fluorine compound such as $MgF_2$ or $CaF_2$. Thanks to this construction, the dependence of the intensity of the reflected light on the temperature is weakened so as to flatten the reflection characteristic curve, and the density of the reflected color is lowered to improve the image clarity of the cathode ray tube. Here, the particles of the conductive oxide or metal contained in the high refractive index film may be so-called ultra fine particles having an average diameter less than 70 nm.

By employing the so-called "sol-gel-method", according to the present invention, the high refractive index film layer of the anti-reflection, anti-electrostatic charge film, having two layers, basically is given a structure in which the interface between the high refractive index film and the low refractive index film on the side of the high refractive index opposite to the glass panel plate is made uneven, so that the density of the reflected light, which is a defect of the two-layered anti-reflection, anti-electrostatic charge film of the prior art, is lowered to flatten the reflection curve. As a result, it is possible to provide a display device, such as a cathode ray tube which can have a lowered average reflectance in the range of 400 to 700 nm and which can have less light scattering, thereby improving the contrast of the display screen and the image clarity.

According to the present invention, moreover, the high refractive index film can be formed by spray-coating to reduce the amount of expensive solution used in the process, whereby the manufacturing process is simplified and the maintenance cost of the manufacturing facility is lowered.

DETAILED DESCRIPTION OF THE PREFERRED EMBODIMENTS

The present invention will be described in detail in connection with various embodiments.

Figure 1:
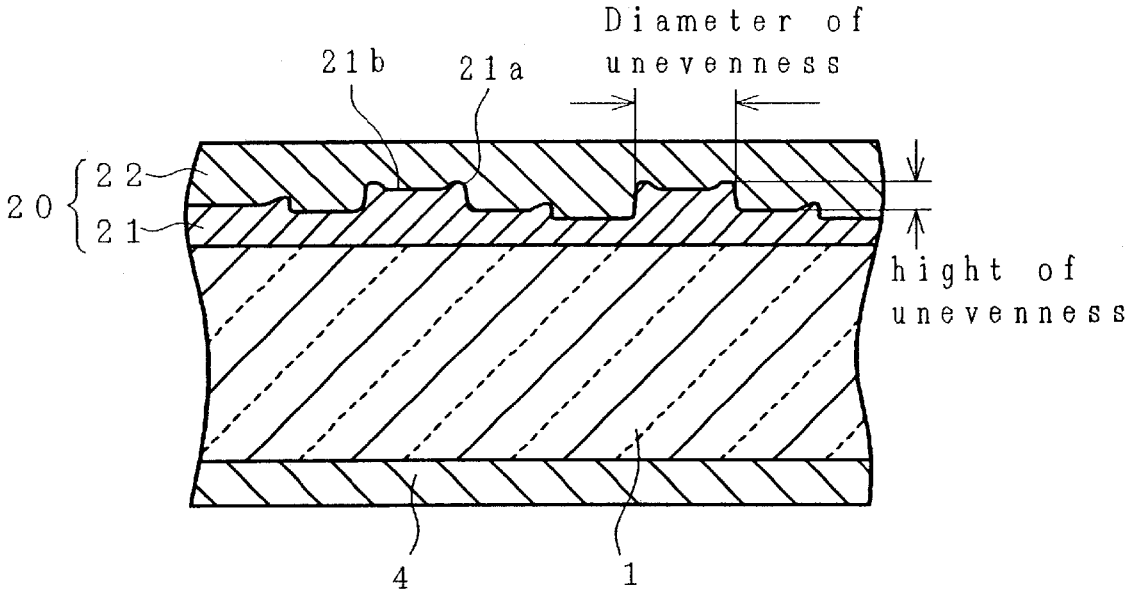
FIG. 1 is a section view showing a portion for explaining the construction of a glass panel portion of a cathode ray tube representing an embodiment of the present invention.

FIG. 1 is a section view of a portion of a glass panel of a cathode ray tube representing a first embodiment of the present invention. In FIG. 1, reference numeral 1 designates a glass panel; numeral 4 denotes a phosphor screen; numeral 20 generally denotes an anti-reflection, anti-electrostatic charge film; numeral 21 denotes a film of high refractive index; numeral 21*a* denotes a projection on the film 21; numeral 21*b* denotes a recess in the film 21; and numeral 22 denotes a film of low refractive index.

In this embodiment, the surface of the high refractive index film 21 is uneven, and the overlying low refractive index film 22 is provided with a flat or generally flat outer surface.

The high refractive index film 21 is formed by spray-coating the surface of the glass panel 1 with an alcohol suspension containing ultra fine particles of metal oxides. A desired unevenness is formed on the surface of the high refractive index film 21 by controlling the content of the material of the spray-coating and the coating conditions. Here, the ultra fine particles of metal oxides have an average diameter of unevenness of 70 nm.

The low refractive index film 22 is formed by spin- or spray-coating with an alcoholic solution of silicon alkoxide.

Figure 2:
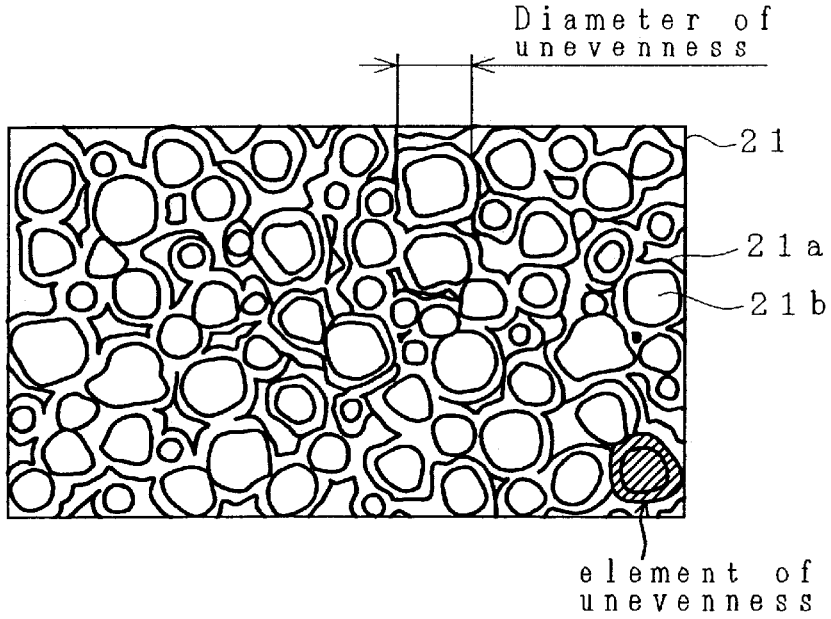
FIG. 2 is an enlarged top plan view for explaining the surface state of a film of high refractive index constituting a layer of the anti-reflection, anti-electrostatic charge film of FIG. 1.

FIG. 2 is an enlarged top plan view for explaining the surface state of the high refractive index film constituting one layer of the anti-reflection, anti-electrostatic charge film of FIG. 1. As shown in FIG. 2, the surface of the high refractive index film 21 is given an unevenness in which the recesses 21*b* are enclosed by the projections 21*a,* and this film 21 is coated with the low refractive index film 22. Thanks to this construction, the characteristic curve of reflection is flattened to lower the average reflectance in the range of 400 to 700 nm, thereby reducing the density of the color of reflected light and improving the image clarity of the cathode ray tube.

Figure 3:
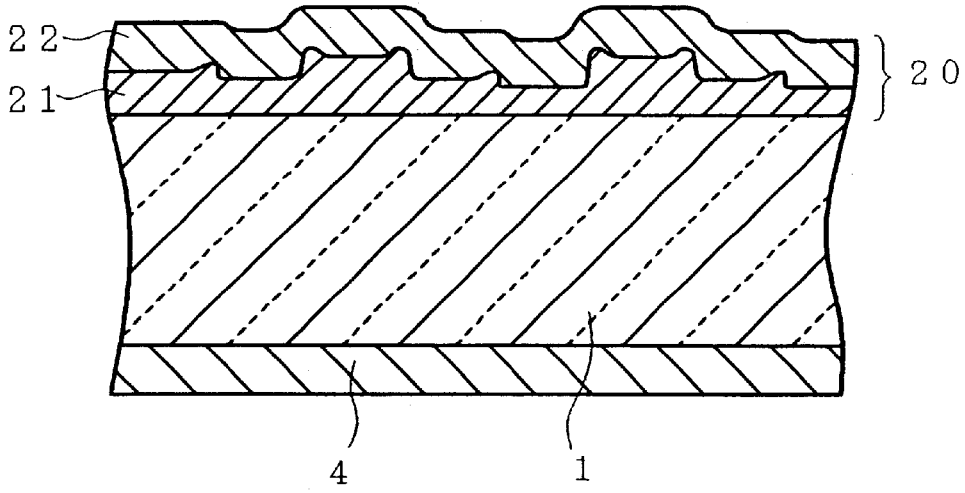
FIG. 3 is a section view showing a portion for explaining the construction of a glass panel portion of a cathode ray tube representing another embodiment of the present invention.

FIG. 3 is a section view of a portion of a glass panel of a cathode ray tube representing a second embodiment of the present invention. The same reference numerals as those of FIG. 1 designate the same elements.

In this embodiment, the outer surface of the low refractive index film 22 forming the upper layer of the anti-reflection anti-electrostatic charge film 20 also has an unevenness corresponding to that of the underlying high refractive index film 21.

Thanks to this construction, the reflection characteristic curve is flattened by the scattering function of incident light due to the unevenness formed on the outer surface of the low refractive index film 22, and the average reflectance in the range of 400 to 700 nm is lowered, thereby reducing the density of the color of the reflected light and improving the image clarity of the cathode ray tube.

Figure 4:
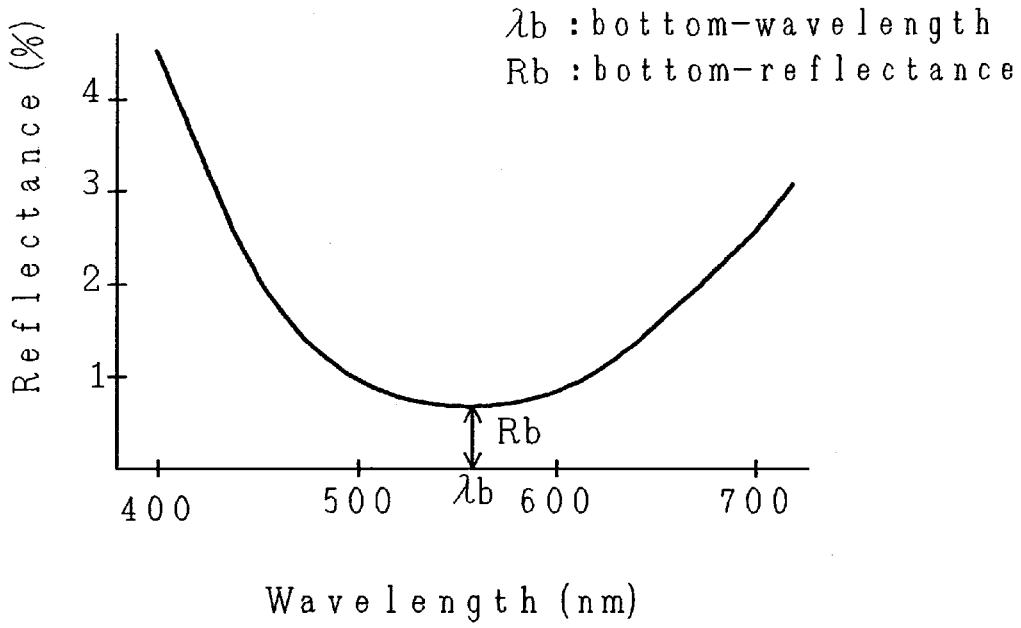
FIG. 4 is a characteristic diagram illustrating the characteristics of reflection of a two-layered anti-reflection, anti-electrostatic charge film.

FIG. 4 is an explanatory view illustrating the characteristics of reflection of a two-layered anti-reflection, anti-electrostatic charge film. The abscissa of FIG. 4 represents wavelength (nm) and the ordinate represents reflectance (%). Here, the graph of FIG. 4 is obtained under measurement conditions using non-polarized light and an incident angle of 5 degrees with a spectrophotometer U3400 of HITACHI, Ltd. The minimum reflectance indicated in FIG. 4 will be referred to as the bottom-reflectance Rb, and the corresponding wavelength will be referred to as the bottom-wavelength $\lambda b$.

Generally, with reference to the thicknesses of the high refractive index film and the low refractive index film which exhibit the minimum reflectance Rb, the bottom-reflectance Rb rises and the reflection curve becomes gentle when the thickness of the high refractive index film deviates from the aforementioned reference thickness. The low refractive index film 22 exerts little influence upon the bottom-reflectance Rb. When the low refractive index film 22 is thicker than the aforementioned reference thickness, however, the bottom-wavelength λb has a tendency to shift to the longer wavelength side than the bottom-wavelength λb corresponding to the bottom-reflectance Rb of the layer having the reference thickness.

If, therefore, the unevenness is within a small range, such as a square having a side larger by about 10 to 100 times than the wavelength of the incident light, or a circle having a diameter larger by about 10 to 100 times the same, a variety of characteristic curves of reflection are achieved corresponding to the shape of the unevenness. The unevenness height acts, if it is no more than 40 nm, as a two-layered reflection film. Here, if the aforementioned one side or diameter is as large as or larger by several times than the wavelength of the light, the scattering of the light is so intensified undesirably as to lower the interfering action of the light.

Figure 5:
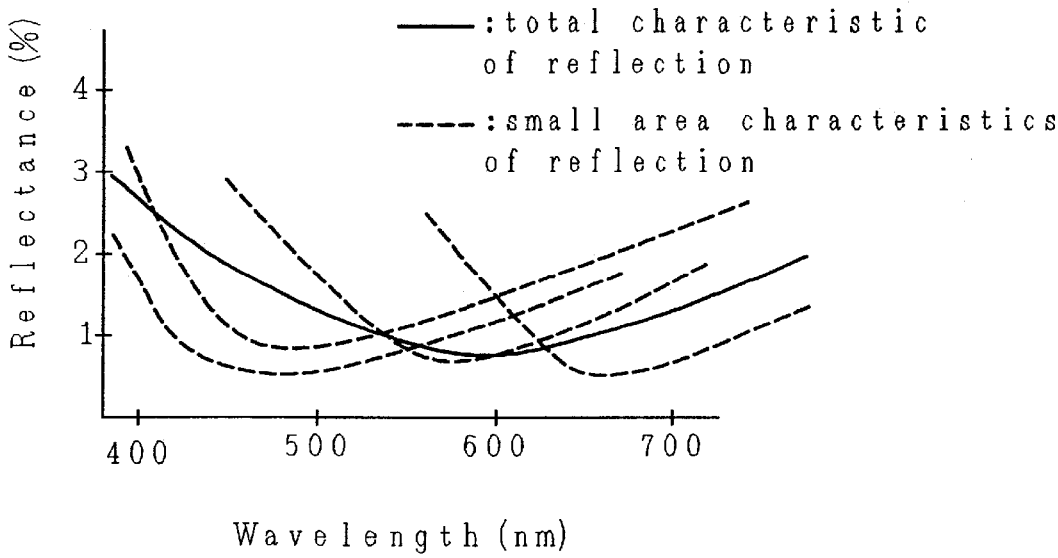
FIG. 5 is a characteristic diagram illustrating the characteristics of reflection of an uneven portion.

FIG. 5 is an explanatory view illustrating the characteristics of reflection of the uneven portion. In FIG. 5, the dotted lines show reflection curves (the characteristics of reflection of arbitrary small area portions), and the solid line shows the reflection curve (the total characteristic of reflection) of the glass panel of the cathode ray tube of the present invention, obtained by combining the reflection characteristics of the small areas. Macroscopically, as illustrated in FIG. 5, the total characteristic of reflection shown by the solid curve is observed. In comparison to the characteristics of the small area portions, the bottom-reflectance Rb slightly rises, but the reflection curve is flatter and the reflection color is light, and the reflectance is in a range as low as 400 to 700 nm.

If this unevenness is provided only on the outer surface of the low refractive index film, the refractive index will be too low to allow the light interference to act. As a result, the height of the unevenness has to be increased to intensify the scattering of the reflection light, thereby degrading the display image of the cathode ray tube.

As has been described with reference to the individual embodiments of the present invention, therefore, a cathode ray tube of high quality, in which the reflection of external light is drastically reduced and the electrostatic charging is prevented, can be provided by a two-layered structure, in which a low refractive index film is laid over a high refractive index film formed on the outer face of the glass panel, a small unevenness is formed at least at the interface between the high refractive index film and the low refractive index film, and a conductive substance is used in the material for the underlying high refractive index film.

A process for manufacturing the cathode ray tube of the present invention now will be described.

Figure 6:
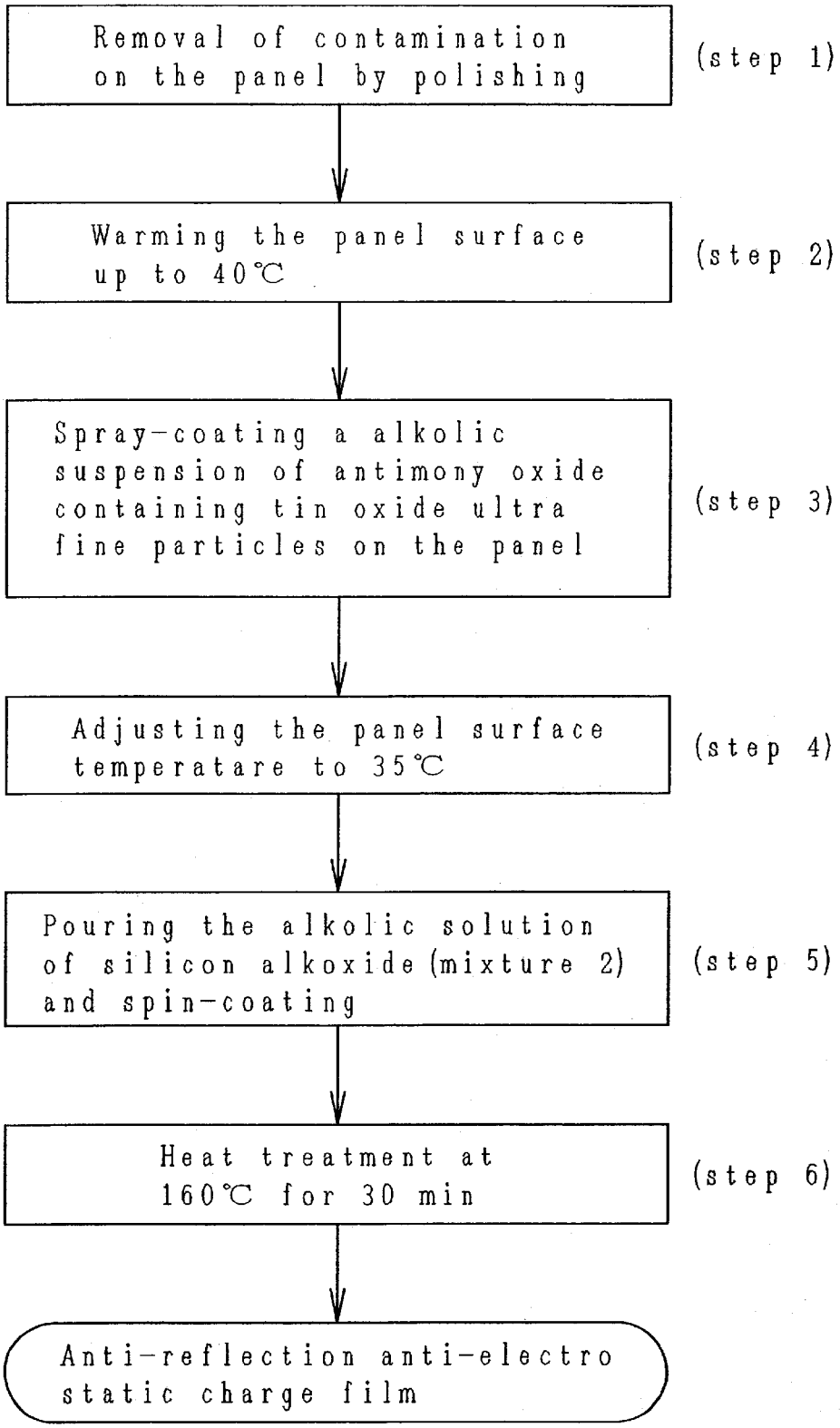
FIG. 6 is a flowchart for explaining an example of a process for manufacturing the cathode ray tube of the present invention.

FIG. 6 is a flowchart for explaining a first example of a process for manufacturing the cathode ray tube of the present invention.

First, the surface of the glass panel of a color display tube having a phosphor screen pitch of 0.26 mm and an effective diagonal length of 41 cm is polished to remove contamination (at step 1). Next, the surface temperature of the glass panel is heated up to 40° C. (at Step 2), and the panel surface is spray-coated with a suspension of a high refractive index material having the below-specified composition (1) (at Step 3). This spray-coating step is performed all over the surface by sweeping the surface of the glass panel at a liquid flow rate of 2 liters/h, at an air flow rate of 2 liters/min and at a spray width of 70 mm. After spraying the whole surface, a similar step is suitably repeated once, twice, or three times. The consumption of the suspension of the high refractive index material used at Step 3 is totally 20 milliliters.

COMPOSITION (1)

Suspension of High Refractive Index Material

| | |
|---|---|
| A.T.O.: Average Particle Diameter of 30 nm | 2 wt. % |
| Ethanol | 16 wt. % |
| Dispersion Agent (KAO Ltd., Trade Name: Demol N | 0.05 wt. % |
| Ethylene Glycol | 0.1 wt. % |
| Ion-Exchange Water | the Balance |

After the spraying of the suspension of the high refractive index material, the surface temperature of the glass panel is adjusted to 35° C. (at Step 4), and 50 milliliters of a solution of a low refractive index material having the below-specified composition (2) is fed and the coater is spun at 150 RPM for 70 sees. to remove the excess solution (at step 5), followed by a heat treatment at 160° C. for 30 mins. (at Step 6).

COMPOSITION (2)

Solution of Low Refractive Index Material

| | |
|---|---|
| $Si(C_2H_5O)_4$: Average of Degree of Polymerization: 1000 | 1.1 wt. % |
| Hydrochloric Acid (in terms of HCl) | 0.005 wt. |
| Ethanol | the Balance |

As a result, there is formed on the glass panel a two-layered anti-reflection, anti-electrostatic charge film, as shown in FIG. 1, which is composed of a lower layer of a high refractive index film having an average diameter of unevenness of 25 μm, a maximum unevenness height of 40 nm, an average film thickness of 80 nm and a refractive index of 1.8, and an upper layer of a low refractive index having an average thickness of 110 nm and a refractive index of 1.46. Here, the average diameter of unevenness was determined by taking a photograph at a magnification of 400 times with an optical interference microscope of OLYMPUS Ltd., sampling ten to 20 particles at random in one field of view, measuring their diameters on the photograph and arithmetically averaging the measured values. Moreover, the maximum height of the unevenness is the maximum roughness Rmax, which was calculated from the image in the field of observation of the scanning electron microscope S-2250N of HITACHI, Ltd. by using an image processor RD550. The average roughness of the unevenness was likewise determined by using the image processor of the scanning electron microscope. The refractive index was obtained by using the automatic ellipsometer (having a light source wavelength of 550 nm) DVA-36VW; or Mizojiri Kogaku Kogyo, Ltd.

This anti-reflection, anti-electrostatic charge film has a surface resistance of $8\times10^6\Omega/\square$, a bottom refractive index of 0.8%, a bottom-wavelength of 570 nm, a refractive index of 3.2% for 400 nm and a refractive index of 2.1% for 700 nm. Here, the surface resistance was measured by using Roresta IP apparatus of DIA INSTRUMENT Ltd. in the atmosphere at a temperature of 25° C. while applying the measurement probe directly to the surface of the formed film. The refractive index was measured under conditions using non-polarized light and an incident angle of 5 degrees with a spectrophotometer U3400 of HITACHI, Ltd.

Figure 7:
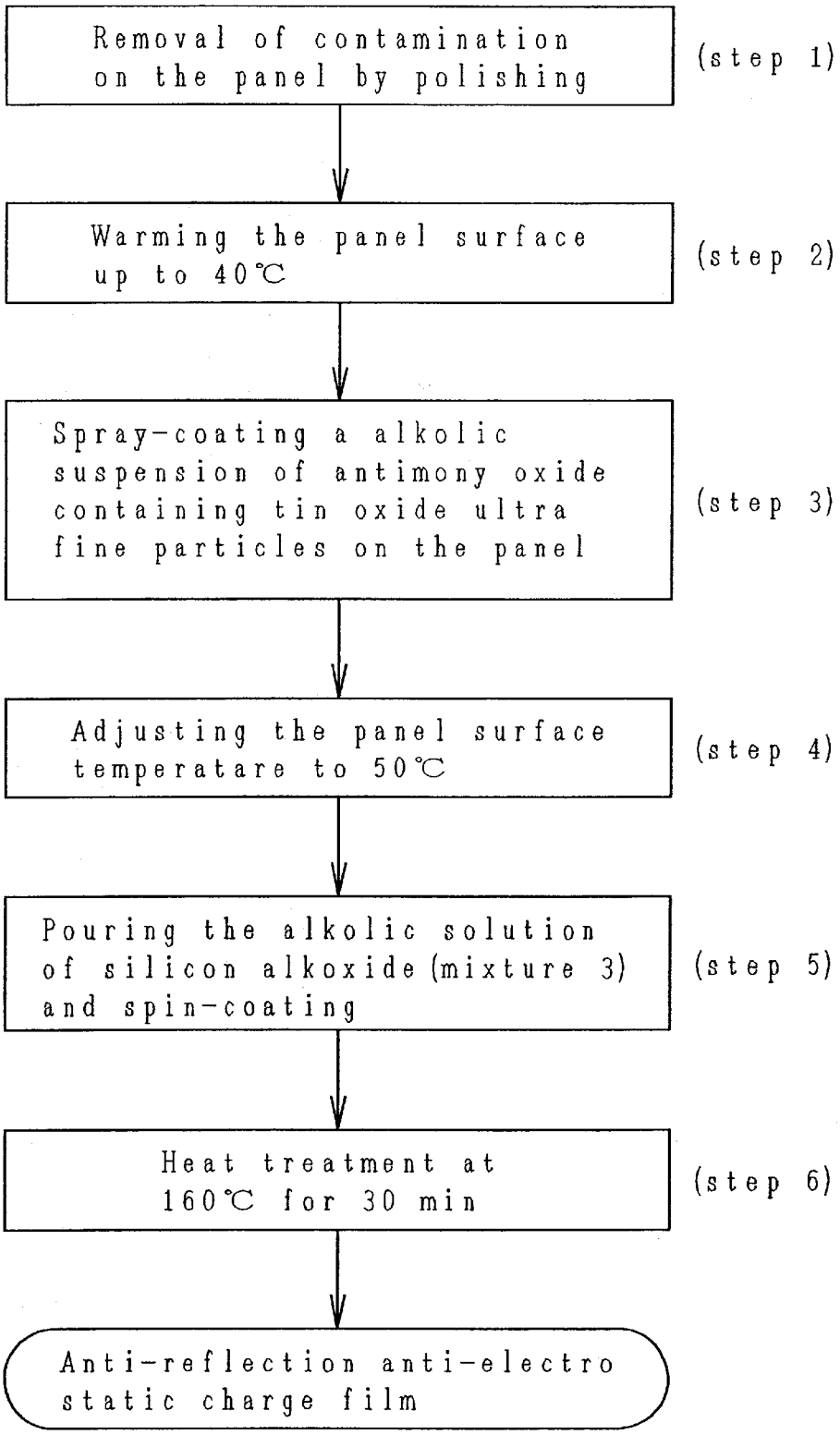
FIG. 7 is a flowchart for explaining another example of a process for manufacturing the cathode ray tube of the present invention.

FIG. 7 is a flowchart for explaining a second example of a process for manufacturing the cathode ray tube of the present invention.

First, the surface of the glass panel of a color display tube having a phosphor screen pitch of 0.26 mm and an effective diagonal length of 41 cm is polished to remove contamination (at Step 1). Next, the surface temperature of the glass panel is heated up to 40° C. (at Step 2), and the panel surface is spray-coated with a suspension of a high refractive index material having the aforementioned composition (1) (at Step 3). This spray-coating step is performed all over the surface by sweeping the surface of the glass panel at a liquid flow rate of 2 liters/in, at an air flow rate of 2 liters/min and at a blow width of 70 mm, and a similar step is suitably repeated once, twice or three times. The consumption of the suspension of the high refractive index material, as used at Step 3, is totally 20 milliliters.

After the spraying of the suspension of the high refractive index material, the surface temperature of the panel glass is adjusted to 50° C. (at Step 4), 50 milliliters of a solution of a low refractive index material having the below-specified composition (3) fed, and the coater is spun at 150 RPM for 70 secs. to remove the excess solution (at Step 5), followed by a heat treatment at 160° C. for 30 min (at Step 6).

COMPOSITION (3)

Solution of Low Refractive Index Material

| | |
|---|---|
| $Si(C_2H_5O)_6$: Average of Degree of Polymerization: 100 | 95 wt. % |
| Hydrochloric Acid (in terms of HCl) | 0.007 wt. % |
| Ethanol | the Balance |

As a result, there is formed on the glass panel a two-layered anti-reflection, anti-electrostatic charge film, as shown in FIG. 2, which is composed of a lower layer of a high refractive index film having an average particle diameter of 25 $\mu$m, the maximum unevenness height of 40 nm, an average film thickness of 80 nm and a refractive index of 1.8, and an upper layer of a low refractive index having an average thickness of 95 nm and a refractive index of 1.46.

This anti-reflection, anti-electrostatic charge film has a surface resistance of $8\times10^6\Omega/\square$, a bottom refractive index of 0.9t, a bottom-wavelength of 530 nm, a refractive index of 3.0% for 400 nm and a refractive index of 2.0% for 700 nm.

Figure 8:
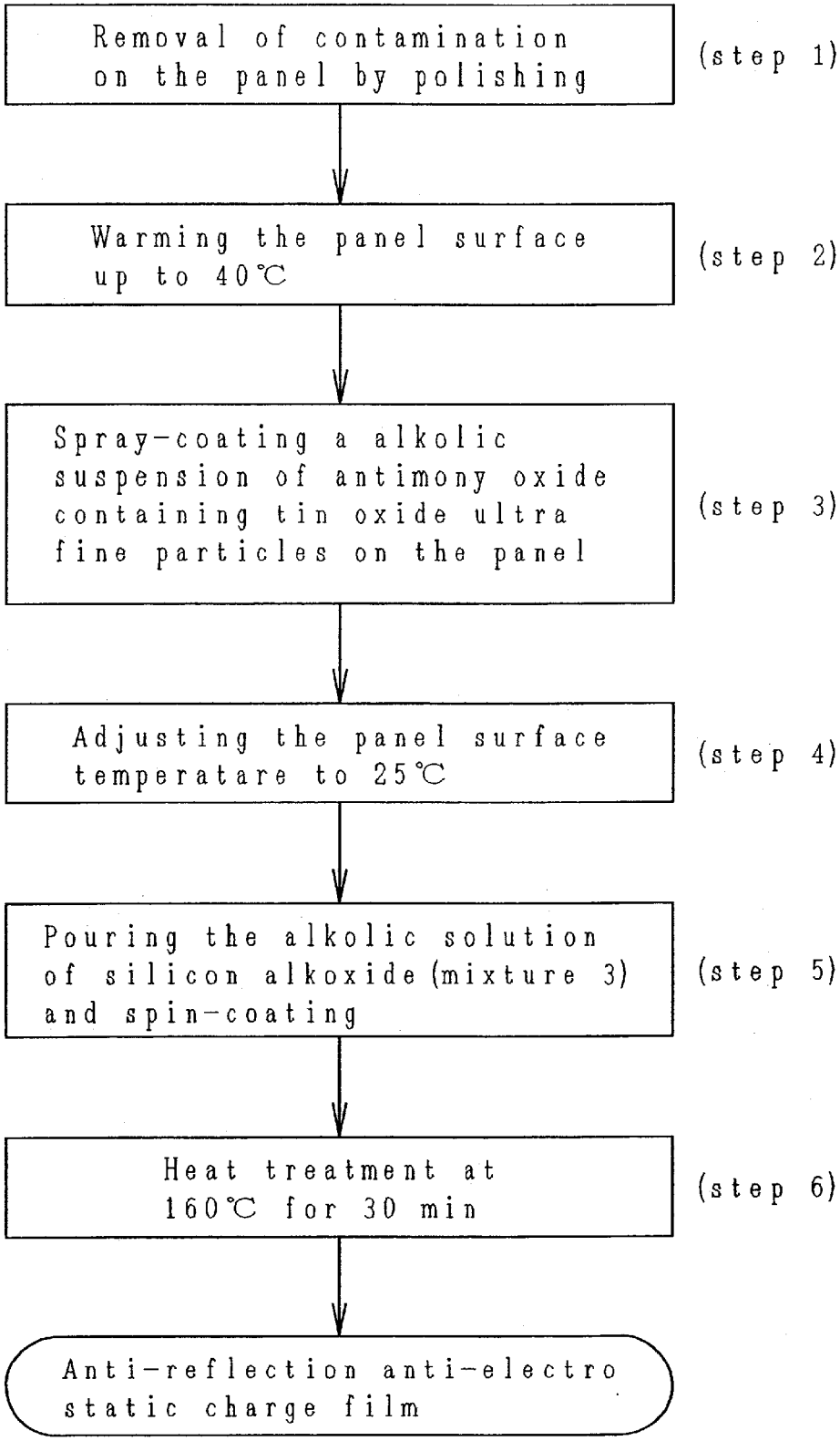
FIG. 8 is a flowchart for explaining still another example of a process for manufacturing the cathode ray tube of the present invention.

FIG. 8 is a flowchart for explaining a third example of a process for manufacturing the cathode ray tube of the present invention.

First, the surface of the glass panel of a color display tube having a phosphor screen pitch of 0.26 mm and an effective diagonal length of 41 cm is polished to remove contamination (at Step 1).

The surface temperature of the glass panel is heated up to 40° C. (at Step 2), and the panel surface is spray-coated with a suspension for a high refractive index material having the aforementioned composition (1) by using a two-fluid nozzle of SPRAYING SYSTEM Ltd. (at Step 3). This spray-coating step is performed all over the surface by sweeping the surface of the glass panel at a liquid flow rate of 2 liters/in, at an air flow rate of 2 liters/min and at a blow width of 70 mm, and a similar step is suitably repeated once, twice, or three times. The consumption of the suspension of the high refractive index material used at Step 3 is totally 20 milliliters. After the spraying of the suspension of the high refractive index material, the surface temperature of the glass panel is adjusted to 25° C. (at Step 4), and a solution of a low refractive index material having the aforementioned composition (3) is spray-coated under the same spray conditions as those of the high refractive index material by using the aforementioned two-fluid nozzle (at Step 5), followed by a heat treatment at 160° C. for 30 min (at Step 6). As a result, there is obtained an anti-reflection, anti-electrostatic charge film which has characteristics substantially similar to those of the aforementioned second example.

Figure 9:
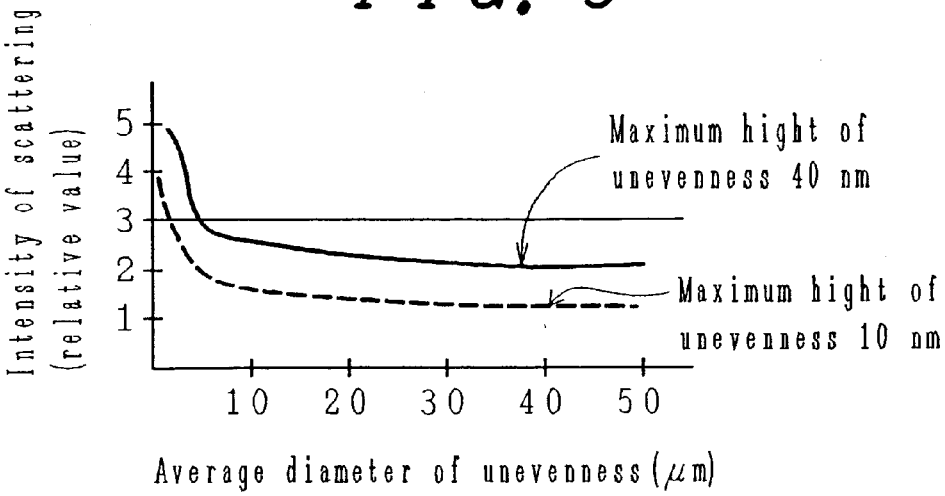
FIG. 9 is a graph illustrating the relations between the average diameter of unevenness and the intensity of scattering of uneven fine particles in a film of high refractive index.

FIG. 9 is a graph illustrating the relations between the average diameter and the intensity of scattering of the unevenness at the interface of the high refractive index film and the low refractive index film. In FIG. 9, the abscissa represents the average diameter ($\mu$m) and the ordinate represents the intensity (in a relative value) of scattering of light by the high refractive index film. A lower intensity (in the relative value) of scattering of light by the film, along the ordinate of FIG. 9, is more desirable, and the allowable level of scattering by the image display screen of the cathode ray tube is no more than an intensity (in the relative value) of 3. In FIG. 9, the dotted curve represents a case where the maximum height of the unevenness is 10 nm, and the solid curve represents a case where the maximum height of unevenness is 40 nm.

Figure 10:
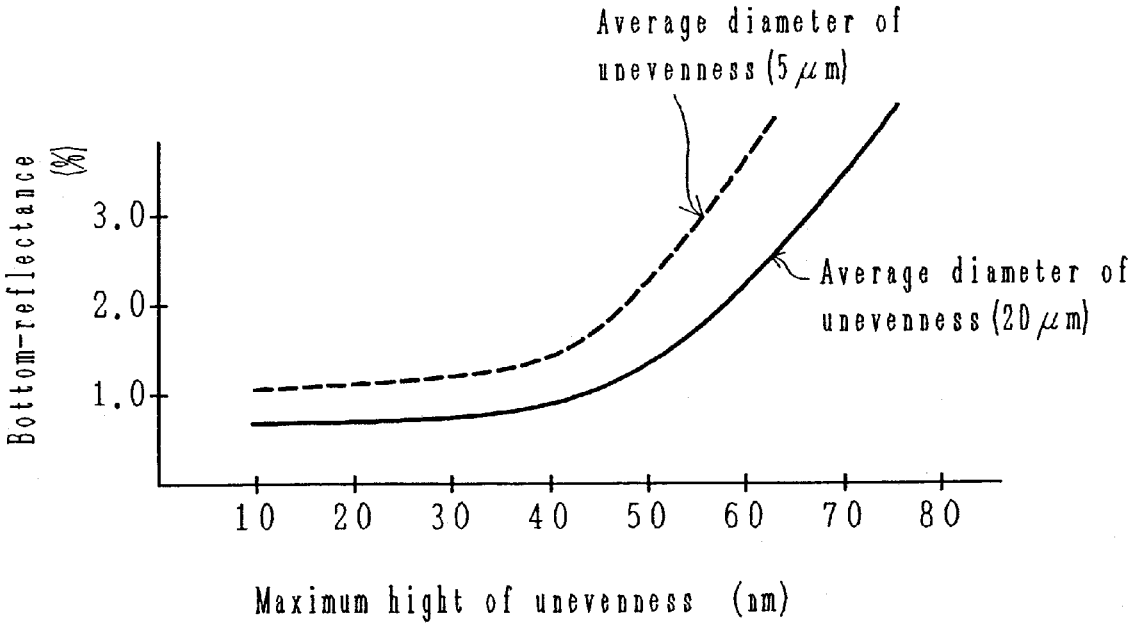
FIG. 10 is a graph illustrating the relations between the maximum height of unevenness and the bottom reflectance of the uneven fine particles in the film of high refractive index.
Figure 11:
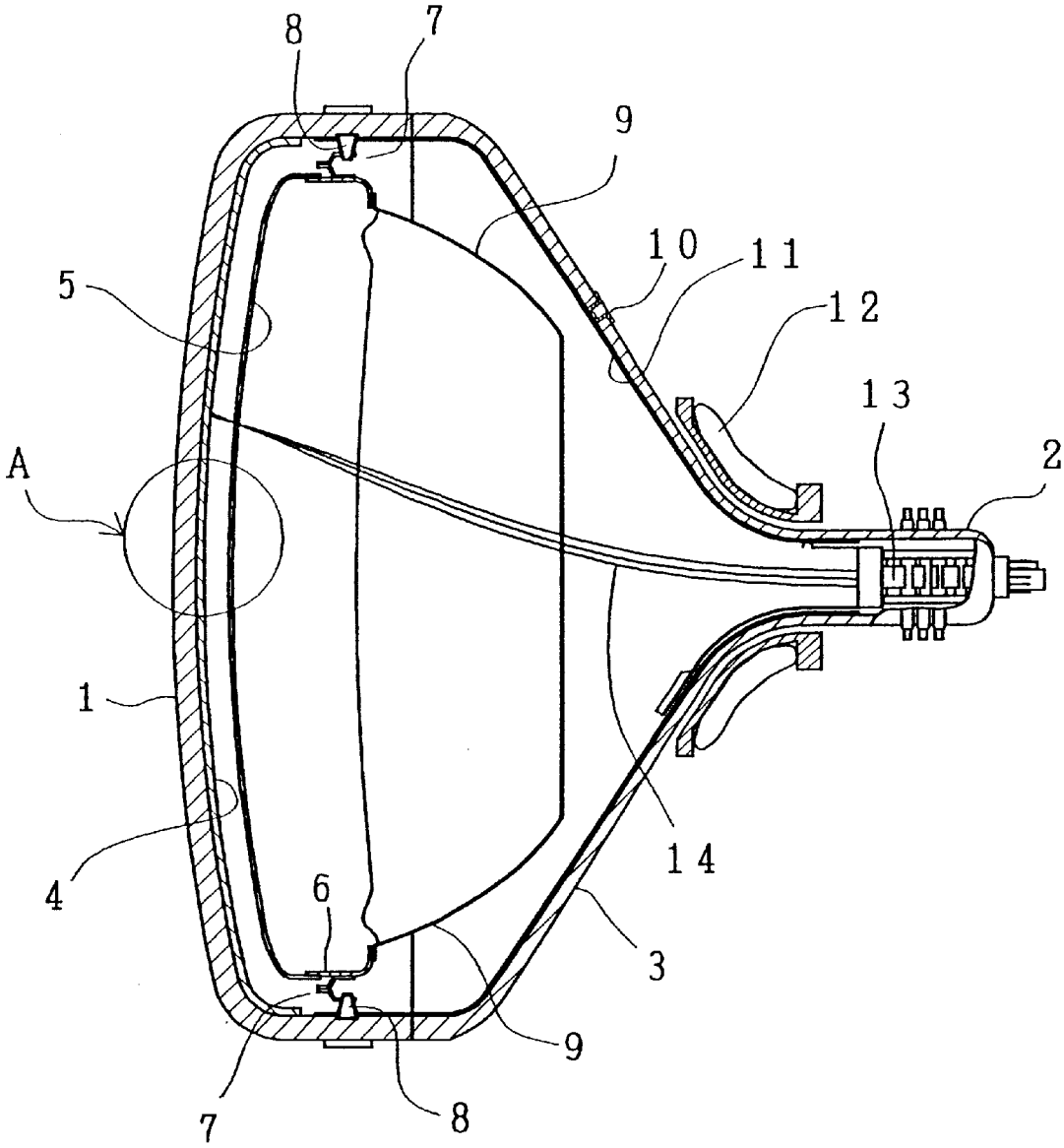
FIG. 11 (PRIOR ART)
FIG. 11 is a section view for explaining the structure of a shadow mask type color cathode ray tube representing a typical example of a cathode ray tube.
Figure 12:
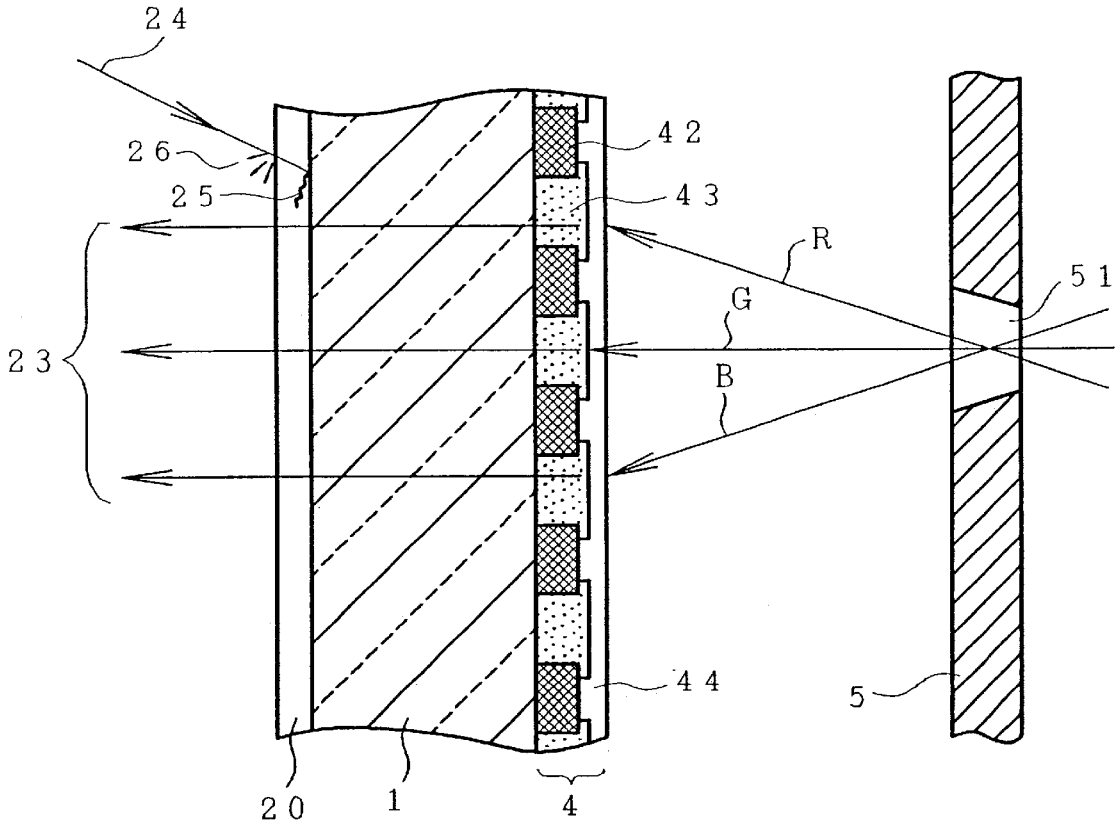
FIG. 12 (PRIOR ART)
FIG. 12 is a section view showing, on an enlarged scale, a portion A of FIG. 11 for explaining one example of an external light anti-reflection structure of a cathode ray tube.

FIG. 10 is a graph illustrating the relations between the maximum height of the unevenness and the bottom-reflectance at the interface of the high refractive index film and the low refractive index film. In FIG. 10, the abscissa represents the maximum height of the unevenness (nm) and the ordinate represents the bottom-reflectance (%) of the high refractive index film. In FIG. 10, the dotted curve represents a case where the average diameter (the average diameter of the circumcircles of the photograph taken-by using a phase-contrast microscope) is 5 $\mu$m, and the solid curve plots the case where the average diameter is 20 $\mu$m.

In order to form an anti-reflection, anti-electrostatic charge film having little scattering of light and a low bottom-reflectance, it is desirable for the average diameter to be 5 to 80 $\mu$m and the maximum height of unevenness be no more than 40 nm. When the maximum height of unevenness is no more than 10 nm, the reflection curve takes a V-shape, so that the dependence of the reflectance on the wavelength is intensified and the reflected light is colored blue. Therefore, a maximum height of unevenness of no more than 10 nm is not practical. When the diameter is more than 100 $\mu$m, on the other hand, the roughness of the displayed image is undesirably increased, lowering the smoothness of the displayed image.

In the foregoing embodiments, the A.T.O. is used as the conductive material of the high refractive index film, but similar reflection characteristics were obtained when I.T.O. was employed, and an anti-reflection, anti-electrostatic charge film having a surface resistance of 3 to $8\times10^4\Omega/\square$ was formed.

By a similar process using ultra fine particles of various metals, moreover, various anti-reflection, anti-electrostatic charge films were formed, having surface resistances and bottom-reflectances as listed in Table 1:

TABLE 1

| Substance | Bottom-Reflectances | Surfaces Resistance |
|---|---|---|
| Silver | 0.08% | $2–5\times10^2\ \Omega/\square$ |
| Platinum | 0.1% | $1–3\times10^3\ \Omega/\square$ |
| Gold | 0.1% | $1–5\times10^3\ \Omega/\square$ |
| Palladium | 0.2% | $3–5\times10^3\ \Omega/\square$ |

TABLE 1-continued

| Substance | Bottom-Reflectances | Surfaces Resistance |
|---|---|---|
| Rhodium | 0.2% | 1–6 × $10^3$ Ω/□ |
| Iridium | 0.2% | 3–8 × $10^3$ Ω/□ |

Incidentally, other anti-reflection, anti-electrostatic charge films were formed during a trial by a similar process using other materials including aluminum, nickel, copper, cobalt, chromium, silver alloy, platinum alloy, gold alloy, palladium alloy, rhodium alloy and iridium alloy. Oxides, hydroxides or carbonates were produced depending upon the atmosphere, except for the anti-reflection, anti-electrostatic charge films made of precious metals, and the bottom-reflectance or the surface resistance changed with time, and the characteristics were unstable.

The foregoing embodiments have been described by way of example in which an anti-reflection, anti-electrostatic charge film is formed of two layers. Despite this description, however, the present invention should not be limited to the described example, but can be modified into either a three-layered anti-reflection, anti-electrostatic charge film in which a high refractive index film having the same uneven properties as the low refractive index film and a high intensity of scattering is laid over the two-layered structure, or four- or more-layered film structures in which a high refractive index film and a low refractive index film, basically of the two-layered structure, are alternately formed and the interfaces of layers of different refractive indices are uneven.

According to the individual embodiments thug far described, it is possible to provide a cathode ray tube having an anti-reflection, anti-electrostatic charge film, which prevents the reflection of external light on the glass panel of the cathode ray tube so as to provide for a high contrast image display, and which has little roughness on the panel surface, so that the cathode ray tube can display an image of high resolution, while preventing electrostatic charge formation.

Moreover, the present invention can be applied not only to a cathode ray tube, but also to the screen of a display device, such as a liquid crystal display panel, a plasma display panel or an EL display panel.

What is claimed is:

1. A cathode ray tube comprising a vacuum enclosure, including a glass panel having an inner face coated with a phosphor film to form a screen, a neck portion housing an electron gun, and a funnel portion connecting said glass panel and said neck portion, and an anti-reflection, anti-electrostatic charge film formed on an outer face of said glass panel, said anti-reflection, anti-electrostatic charge film including a high refractive index film having a refractive index of 1.6 to 2.2 and a low refractive index film having a refractive index less than said high refractive index film, said high refractive index film being sandwiched between the outer face of said glass panel and said low refractive index film, wherein the average roughness of an outer surface of said low refractive index film is less than an average roughness of an unevenness of an interface between said high refractive index film and said low refractive index film, and wherein the high refractive index film is conductive and includes at least one selected from the group consisting of electrically conductive metal oxide particles and metal particles.

2. A cathode ray tube according to claim 1, wherein said low refractive index film contains at least one selected from the group consisting of a silicon compound and a fluorine compound.

3. A cathode ray tube according to claim 1, wherein a pitch of said screen formed by said phosphor film is less than 0.26 mm.

4. A cathode ray tube comprising a vacuum enclosure including (1) a glass panel having an inner face and an outer face, said inner face being coated with a phosphor film to form a screen, (2) a neck portion housing an electron gun, and (3) a funnel portion connecting said glass panel and said neck portion; wherein the outer face of said glass panel is coated with a first layer, the first layer being an electrically conductive layer including at least one selected from the group consisting of electrically conductive metal oxide particles and metal particles, the first layer having a refractive index of 1.6 to 2.2, and said first layer is covered by a second layer having an outer surface, said second layer has substantially no light absorption, a refractive index of said second layer is smaller compared with a refractive index of said first layer, and the outer surface of said second layer is less rough compared with the surface of said first layer at the interface between said first layer and said second layer.

5. A cathode ray tube comprising a vacuum enclosure including (1) a glass panel having an inner face and an outer face, said inner face being coated with a phosphor film to form a screen, (2) a neck portion housing an electron gun, and (3) a funnel portion connecting said glass panel and said neck portion; wherein the outer face of said glass panel is coated with a first layer, the first layer being an electrically conductive layer including at least one selected from the group consisting of electrically conductive metal oxide particles and metal particles, and said first layer is covered by a second layer having an outer surface, said second layer has substantially no light absorption, a refractive index of said second layer is smaller compared with a refractive index of said first layer and is in a range of 1.3–1.58, and the outer surface of said second layer is less rough compared with the surface of said first layer at the interface between said first layer and said second layer.

6. A cathode ray tube comprising a vacuum enclosure including (1) a glass panel having an inner face and an outer face, said inner face being coated with a phosphor film to form a screen, (2) a neck portion housing an electron gun, and (3) a funnel portion connecting said glass panel and said neck portion; wherein the outer face of said glass panel is coated with an electrically conductive first layer including at least one selected from the group consisting of electrically conductive metal oxide particles and metal particles, the first layer having a refractive index of 1.6 to 2.2, and said first layer is covered by a second layer having an outer surface, said second layer has substantially no light absorption, a refractive index of said second layer is smaller compared with a refractive index of said first layer, the outer surface of said second layer is less rough compared with the surface of said first layer at the interface between said first layer and said second layer, and wherein a roughness Rz of said outer surface of said second layer is not more than 10 nm.

7. A cathode ray tube comprising a vacuum enclosure including (1) a glass panel having an inner face and an outer face, said inner face being coated with a phosphor film to form a screen, (2) a neck portion housing an electron gun, and (3) a funnel portion connecting said glass panel and said neck portion; wherein the outer face of said glass panel is coated with an electrically conductive first layer including at least one selected from the group consisting of electrically conductive metal oxide particles and metal particles, and said first layer is covered by a second layer having an outer surface, said second layer has substantially no light absorption, a refractive index of said second layer is smaller compared with a refractive index of said first layer and is in a range of 1.3–1.58, the outer surface of said second layer is less rough compared with the surface of said first layer at the interface between said first layer and said second layer, and wherein a roughness Rz of said outer surface of said second layer is not more than 10 nm.

8. A cathode ray tube comprising a vacuum enclosure, including a glass panel having an inner face and an outer face, said inner face being coated with a phosphor film to form a screen, a neck portion housing an electron gun, and a funnel portion connecting said glass panel and said neck portion, wherein the outer face of said panel is coated with a first layer, the first layer being an electrically conductive layer including at least one selected from the group consisting of electrically conductive metal oxide particles and metal particles, and said first layer is covered by a second layer having an outer surface, wherein said second layer has substantially no light absorption, and a refractive index of said second layer is smaller compared with a refractive index of said first layer, and wherein the number of projections and recesses per unit area of said outer surface of said second layer is less than the number of projections and recesses per unit area of an interface between said first layer and said second layer.

9. A cathode ray tube according to claim 8, wherein the average roughness Rz of the unevenness of the outer surface of said second layer is less than the average roughness Rz of the unevenness of said first layer at the interface between said first layer and said second layer.

10. A cathode ray tube according to claim 8, wherein said second layer substantially consists of at least one material selected from the group consisting of a silicon compound and a fluorine compound.

11. A cathode ray tube according to claim 8, wherein said metal oxide particles of said first layer substantially consist of at least one selected from the group consisting of tin oxide containing antimony oxide and indium oxide containing tin oxide.

12. A cathode ray tube according to claim 8, wherein an average particle diameter of said conductive metal oxide particles or said metal particles is less than 70 nm.

13. A cathode ray tube comprising a vacuum enclosure, including a glass panel having an inner face and an outer face, said inner face being coated with a phosphor film to form a screen, a neck portion housing an electron gun, and a funnel portion connecting said glass panel and said neck portion, wherein the outer face of said panel is coated with a first layer, the first layer being an electrically conductive layer including particles of precious metal, and said first layer is covered by a second layer having an outer surface, wherein a refractive index of said second layer is smaller compared with a refractive index of said first layer, and wherein the number of projections and recesses per unit area of said outer surface of said second layer is less than the number of projections and recesses per unit area of an interface between said first layer and said second layer.

14. A cathode ray tube according to claim 13, wherein said particles of precious metal are selected from the group consisting of silver (Ag), platinum (Pt), gold (Au), palladium (Pd), rhodium (Rh), and iridium (Ir).

15. A cathode ray tube according to claim 13, wherein said second layer has substantially no light absorption.

16. A cathode ray tube according to claim 13, wherein said second layer substantially consists of at least one material selected from the group consisting of a silicon compound and a fluorine compound.

17. A cathode ray tube according to claim 13, wherein the outer surface of said second layer is less rough compared with that of an interface between said first layer and said second layer.

18. A picture tube according to claim 13, wherein an average diameter of said particles of precious metal are not more than 70 nm.

19. A cathode ray tube according to claim 13, wherein a roughness Rz of the outer surface of said second layer is not more than 10 nm.

20. A cathode ray tube according to claim 13, wherein said first layer is directly coated on said outer surface of the panel.

* * * * *